US009447637B2

(12) United States Patent
Morrow et al.

(10) Patent No.: US 9,447,637 B2
(45) Date of Patent: Sep. 20, 2016

(54) AUTOMATIC FOLDABLE LADDER

(71) Applicant: Loftease Attic Stairs Limited, Castlerea, Co. Galway (IE)

(72) Inventors: Peter Morrow, Co. Galway (IE); Philip Gunning, Co. Galway (IE); Sean Canney, Co. Galway (IE)

(73) Assignee: LOFTEASE ATTIC STAIRS LIMITED, Galway (IE)

( * ) Notice: Subject to any disclaimer, the term of this patent is extended or adjusted under 35 U.S.C. 154(b) by 0 days.

(21) Appl. No.: 14/533,710

(22) Filed: Nov. 5, 2014

(65) Prior Publication Data

US 2015/0122580 A1 May 7, 2015

(30) Foreign Application Priority Data

Nov. 6, 2013 (EP) ..... 13191834

(51) Int. Cl.
*E04F 11/06* (2006.01)
*E06C 1/12* (2006.01)

(52) U.S. Cl.
CPC ..... *E06C 1/12* (2013.01); *E04F 11/062* (2013.01); *E04F 11/064* (2013.01)

(58) Field of Classification Search
CPC ..... E06C 1/383; E06C 1/12; E04F 11/064; E04F 11/06; E04F 11/062
USPC ..... 182/77–81
See application file for complete search history.

(56) References Cited

U.S. PATENT DOCUMENTS

| | | | | |
|---|---|---|---|---|
| 6,886,661 | B1 * | 5/2005 | Battenberg | E04F 11/04 182/77 |
| 6,986,485 | B2 * | 1/2006 | Farnsworth | B64D 11/003 182/77 |
| 2009/0166129 | A1 * | 7/2009 | Siler et al. | 182/158 |
| 2009/0255757 | A1 * | 10/2009 | Burke | 182/78 |
| 2009/0288351 | A1 * | 11/2009 | Burke | 52/183 |
| 2011/0127113 | A1 * | 6/2011 | Vanderburgh | B66B 9/0869 187/200 |
| 2012/0199417 | A1 * | 8/2012 | Richey | E06C 1/383 182/129 |

FOREIGN PATENT DOCUMENTS

| | | | |
|---|---|---|---|
| DE | 3318400 | A1 | 11/1984 |
| GB | 333595 | A | 8/1930 |
| WO | 2006122970 | A1 | 11/2006 |

OTHER PUBLICATIONS

European Search Report for EP13191834 dated Apr. 4, 2014.

* cited by examiner

*Primary Examiner* — Daniel Cahn
(74) *Attorney, Agent, or Firm* — Shumaker, Loop & Kendrick, LLP

(57) ABSTRACT

A foldable ladder for providing access to an opening including: a first motorized drive mechanism for moving a cover for the opening between a closed position and an open position; a second motorized drive mechanism coupled to a plurality of foldable ladder portions for moving the ladder portions between a folded configuration and an unfolded configuration; such that, in moving the cover between the closed and an open position, the first motorized drive mechanism triggers the second motorized drive mechanism to move the ladder portions between the folded configuration and unfolded configuration.

10 Claims, 5 Drawing Sheets

AUTOMATIC FOLDABLE LADDER

REFERENCE TO RELATED APPLICATION

This application claims priority from European Patent Application No. 13191834 filed on Nov. 6, 2013, the entirety of which is incorporated herein by reference.

TECHNICAL FIELD AND BACKGROUND

The present disclosure relates to a foldable ladder device. In particular, this disclosure relates to a foldable ladder device which may be folded or unfolded without requiring manual effort.

In a house or commercial premises, there is frequently an upper room or area to which access is not required on a frequent basis. Because of this, it is unnecessary to have a permanent means, such as a staircase, of accessing the upper area in question. It is desirable that the area be ordinarily sealed off and with access provided by a means which is temporarily fixed in place.

Many such solutions exist to solve the aforementioned problem. However, these solutions suffer from a number of disadvantages. Solutions such as those described in US2009/0166129 and GB311390 are bulky and occupy large amounts of space in the upper area when not in use. EP 1 035 268 provides a foldable solution, wherein a ladder arrangement may be folded when not in use and unfolded to allow access to the upper area. However, EP 1 035 268 relies on a complex arrangement of bars and folding elements to achieve its folding function. Further solutions known in the art provide for a foldable action, however a manual interaction with the device is required to move the device from folded to an unfolded configuration.

A solution which overcomes the above problems would be an improvement on the state of the art.

SUMMARY OF THE INVENTION

Disclosed is a foldable ladder for providing access to an opening that includes: a first motorized drive mechanism for moving a cover for the opening between a closed position and an open position; a second motorized drive mechanism coupled to a plurality of foldable ladder portions for moving the ladder portions between a folded configuration and unfolded configuration; such that, in moving the cover between the closed and the open position, the first motorized drive mechanism triggers the second motorized drive mechanism to move the ladder portions between the folded configuration and the unfolded configuration.

This provides the advantage of a fully automated device which can move from a folded configuration, in which an opening is sealed, to an unfolded configuration in which access to the opening is provided. The dual drive mechanism arrangement provides for a smooth transition between folded and unfolded states and overcomes the need for excessive bracketing and cabling to transition between the states. Furthermore, the invention provides that no manual interaction with the ladder is required on the part of a user to transition between the states, unlike other solutions in which the cover must be manually opened or the ladder manually extracted.

In moving the ladder portions between the unfolded and the folded configuration, the second motorized drive mechanism may trigger the first motorized drive mechanism to move the cover between an open position and a closed position. This provides for a smooth transition between unfolded and folded states and further provides that no manual interaction with the ladder is required on the part of a user to transition between the states.

The first and second drive mechanisms may include electrical actuators. This provides for reliable automation of the first and second drive mechanisms.

The second drive mechanism may be positioned to the cover. This allows the second drive mechanism to unfold the ladder once triggered by the motion of the first drive mechanism and resultant opening of the cover. This further provides for a compact design which occupies space on the opening cover rather than occupying space within the upper area to which access is provided by the ladder.

The second drive mechanism may drive a gear arrangement. The gear arrangement may include a rack and pinion arrangement. This allows for a very smooth motion between folded and unfolded states to be achieved. It allows for control and adjustment of the motion of the ladder, if required, to suit the particular location in which the ladder is to be fitted and the space into which it is to extend.

The plurality of foldable ladder portions may include a first portion fixed to the cover; a second portion hingedly connected to the first portion; a third portion hingedly connected to the second portion. Hinging the second portion to the first portion allows the motorized motion of the first portion to control the second portion. Likewise, hinging the third portion to the second portion allows the motion of the second portion to control the third portion.

In the folded configuration, the first, second and third portions may rest atop each other. This further provides for a compact design which minimizes the space occupied by the folded ladder in the upper area to which access is provided by the ladder.

In the unfolded configuration, the first, second and third portions may abut each other. This has the advantage of providing a continuous set of rungs to allow for ease of access to the opening.

The third portion may further include an extendible end piece. This allows the third portion to be adjusted to fit a range of floor to ceiling heights when the ladder is in an unfolded configuration.

The extendible end piece may include a wheel. The wheel provides the advantage of preventing scraping or dragging on a floor surface when the ladder is moved between configurations.

The first and second drive mechanisms may be activatable by remote control. This allows the ladder to be fully automated and requiring no manual intervention by a user, save for pushing of a button on a remote control device to move the ladder between a folded and unfolded configuration and vice versa.

The first and second drive mechanisms may include a secondary power source in case of failure of a primary power source. As such, in case of power failure, the ladder may still be operated.

BRIEF DESCRIPTION OF THE DRAWINGS

Embodiments of the present disclosure will be described, by way of example only, with reference to the accompanying drawings, in which.

DETAILED DESCRIPTION

The invention will now be described more fully with reference to the accompanying figures in which exemplary embodiments of the invention are shown. However, the invention may be embodied in many different forms and should not be construed as limited to the representative embodiments described below. The exemplary embodiments are provided so that this disclosure will be both thorough and complete and will fully convey the scope of the invention and enable one of ordinary skill in the art to make, use, and practice the invention.

Figure 1:
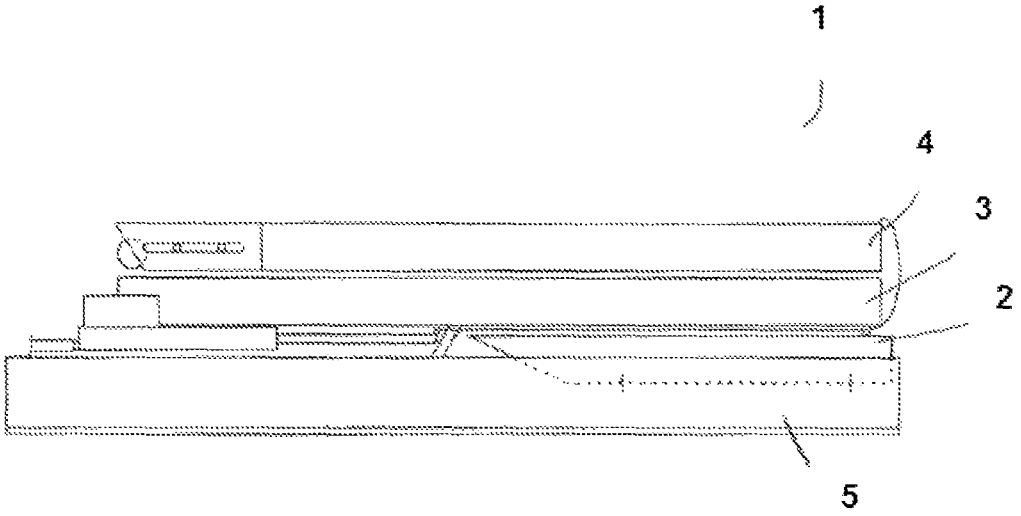
FIG. 1 shows the ladder according to one embodiment in the closed or folded configuration.
Figure 2:
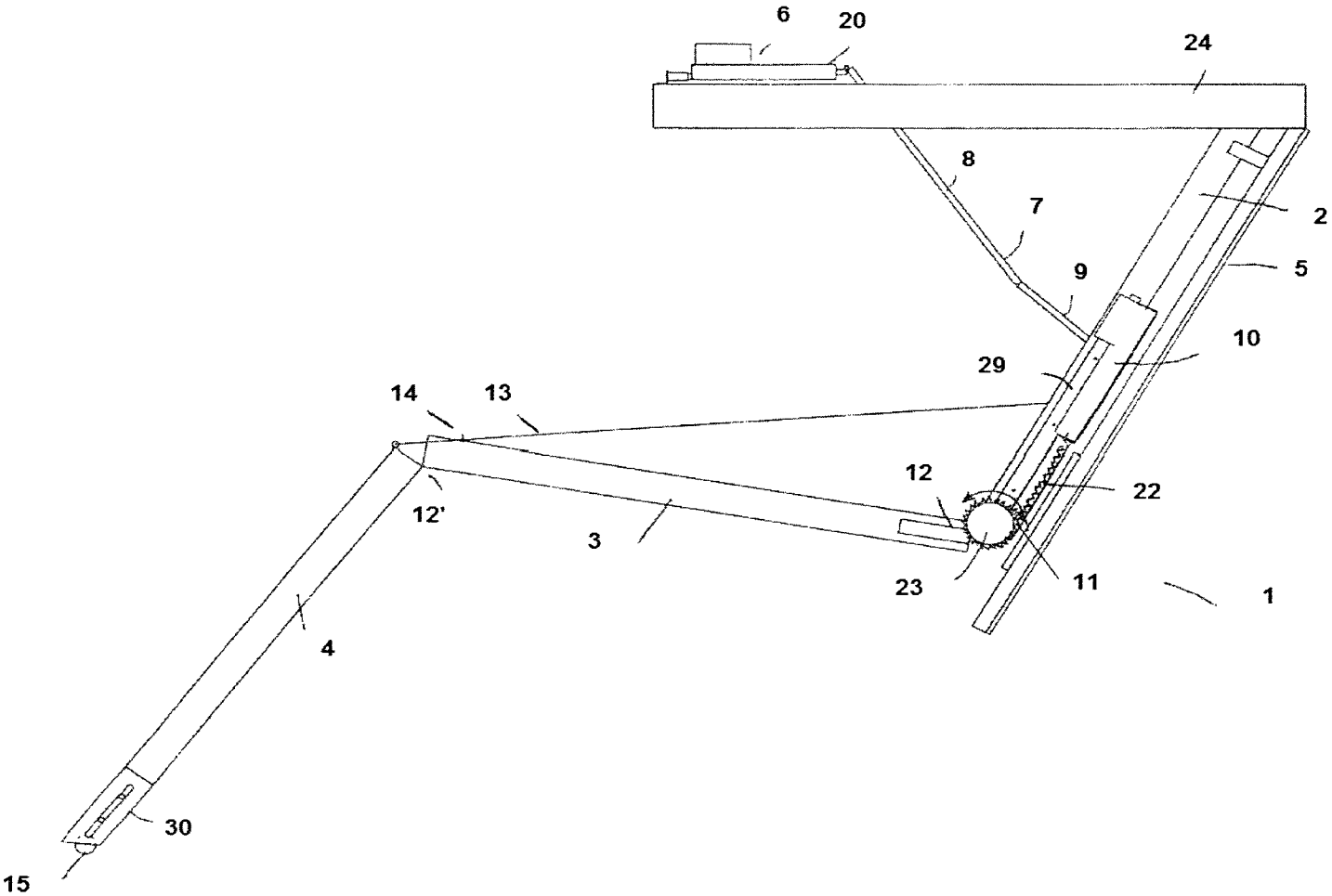
FIG. 2 shows the ladder in a partially unfolded configuration.

FIG. 1 shows the ladder 1 in a folded configuration. The ladder includes a first portion 2, a second portion 3 and a third portion 4 which rest atop each other. The first portion is further fixed to a cover 5 such as a door. The cover 5 serves to seal the opening to which the ladder 1 provides access, when the ladder is in the folded configuration. Further components of the ladder can be seen in FIG. 2 in which the ladder is in a partially unfolded configuration. A first drive mechanism 6 is coupled to the first portion 2 of the ladder by a pair of arm elements 7, 7'. The arm elements may be foldable along their length into upper pieces 8, 8' which are pivotably connected to the drive mechanism 6 and lower pieces 9, 9' which are pivotably connected to the cover 5. The lower pieces may also be pivotably connected to the first portion 2 of the ladder 1. The first drive mechanism comprises a pair (20,21) of electrical actuators.

Figure 3:
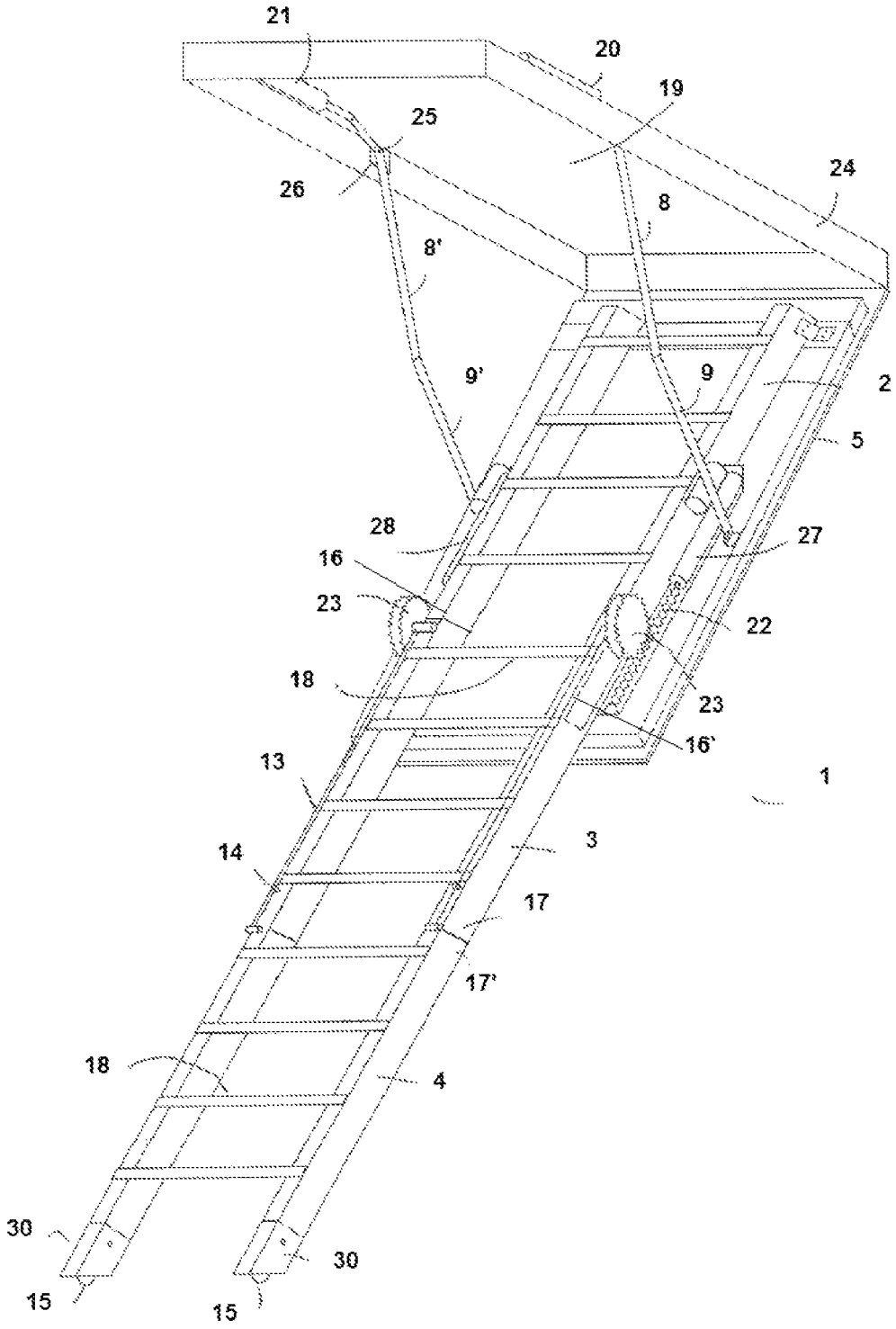
FIG. 3 shows the ladder in an open or unfolded configuration.

A second drive mechanism 10 is attached to the cover 5 and to the first portion 2 of the ladder 1. The second drive mechanism comprises a pair (27,28) of electrical actuators (FIG. 3). The second drive mechanism drives a gear arrangement 11 which controls the separation of the second portion 3 of the ladder from atop the first portion 2 of the ladder when the ladder is moved from the folded to the unfolded configuration. Likewise, the second drive mechanism drives the gear arrangement 11 to control the movement of the second portion 3 of the ladder to atop the first portion 2 of the ladder when the ladder is moved from the unfolded to the folded configuration. The gear arrangement is a rack 22 and pinion 23 type arrangement. The second portion 3 is coupled to the first portion by means of a hinge 12.

The third portion 4 is coupled to the second portion by means of a hinge 12'. The third portion 4 is further coupled to the first portion 2 by means of a cable 13. A guidepiece 14 for the cable 13 is provided on the second portion 3 so that when moving between the folded and unfolded configurations, the movement of the cable 13 may be controlled.

The third portion further comprises an end piece 30. The end piece comprises a wheel 15 which prevents scraping or dragging on a floor surface when the ladder is moved between configurations. The end piece may be extendible such that the third portion 4 can be adjusted to fit a range of floor to ceiling heights when in an unfolded configuration.

FIG. 3 shows the ladder 1 in a fully unfolded configuration. The lower end 16 of first portion 2 abuts the upper end 16' of the second portion 3, the lower end 17 of the second portion abuts the upper end 17' of the third portion 4. In this manner, a continuous set of rungs 18 is provided to allow a user access the opening 19.

Figure 4:
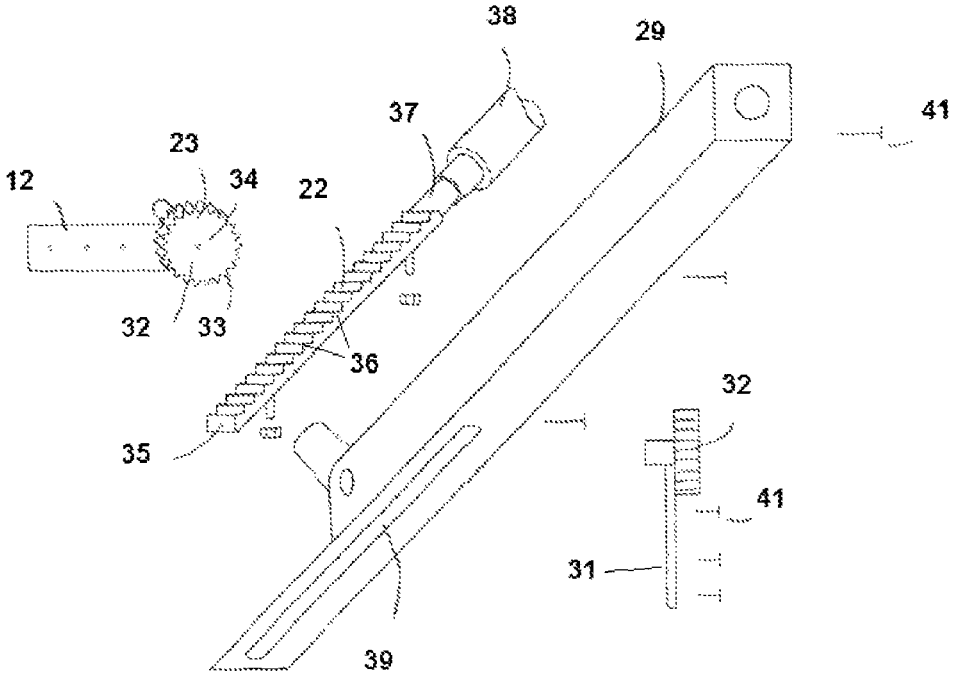
FIG. 4 shows an exploded view of the rack and pinion mechanism of the device.

FIG. 4 shows an exploded view of the rack 22 and pinion 23 mechanism of the device. A pinion piece 23 is fixed to a pinion bracket 31 which is positioned on the lower end of each side of the first portion 2. The pinion 23 consists of a circular piece 32 with a toothed circumference 33. The pinion 23 rotates around a central axis point 34. The pinion bracket 31 is integrated into the hinge 12 which couples the second portion 3 to the first portion 2. A rack is positioned on each side of the lower end of the first portion 2 and is held to the first portion by means of a bracket 29. Each rack 22 consists of a toothed track 35 with a series of teeth 36 dimensioned to engage with the toothed circumference 33 of the pinion. Each rack 22 is fixed to an arm 37 of the each of the actuators (27,28). The arm 37 is moveable in an out of a sleeve piece 38, such that when the actuator extends, the arm 37 extends from the sleeve piece and when the actuator retracts, the arm 37 is drawn into the sleeve piece 38. The rack 22 and pinion 23 are positioned such that when the arm 37 of the actuator extends or retracts, the pinion 23 rotates over the toothed track of the rack 22. The rack and pinion may be made from plastic or a similar durable material. The bracket 29 may be made from plastic or aluminium while the ladder portions may be made from wood, plastic or aluminium. The bracket 29 and hinge 12 may be fixed to the ladder portions by fastening means 41, for example by nails or by screws.

The ladder 1 will now be described in use. With the ladder 1 in its folded configuration, the cover 5 is closed. The pair of actuators 20, 21 of the first drive mechanism are in a fully extended position. The actuators 20, 21 may be activated by means of a remote control. When activated, the actuators retract to allow the arm elements 7, 7' to drop the cover 5 to an open position. The actuators may pull a cable, drive a lever or drive a gear arrangement in order to drop the cover 5 to an open position. The upper pieces 8, 8' of the arms are attached to a fixed frame 24 surrounding the opening 19 and are operated by the actuators. There is a joint 25 in the upper pieces 8,8' coupled to a bracket 26 on the fixed frame 24. Adjustment of the position of the bracket 26 on the frame 24 ensures that the actuators (20,21) can fully close the cover 5 when the ladder 1 is in the folded configuration. The lower pieces 9, 9' of the arm elements 7, 7' are attached to the cover 5. The upper and lower pieces are joined by a nut and bolt to create an elbow type joint.

When the arm elements are almost fully extended and the cover 5 is in a partially open configuration, the actuators 27, 28 of the second drive mechanism are activated by a switch mounted on the actuators 20, 21 of the first drive mechanism. The second drive mechanism is triggered when the actuators 20, 21 of the first drive mechanism have almost fully retracted. The actuators 27, 28 of the second drive mechanism are in a fully extended position when the ladder 1 is in the folded configuration and the cover 5 is closed. When the second drive mechanism is activated, the actuators 27, 28 retract. The actuator arm 37 is thus drawn into the sleeve piece 38 which has the effect of pulling the rack 22 beneath the pinion 23. The pinion 23 rotates upon the rack surface and as it does so, the second ladder portion 3 is unfolded from the first portion 2. The actuators 27, 28 are each joined to a rack 22 which slides within a channel 39 on the base of the bracket 29. The pinion 23 is mounted on the side of the hinge 12. As the rack 22 is engaged with the pinion 23 it unfolds the second portion 3 of the ladder 1. As the second portion 3 unfolds, the third portion 4 begins to unfold under the force of gravity and its movement is controlled by the cable 13. The cable 13 is attached from the hinge 12' at the upper end of the third portion through the guidepiece 14 on the second portion 3 to the bracket 29 on the first portion 2. The cable 13 it is attached to a spring or elastic means on the first portion 2. This arrangement keeps the cable 13 taut when the ladder 1 is in the folded configuration.

When the actuators 27, 28 are fully retracted, the ladder 1 is in the unfolded configuration and access to the opening 19 is provided. The end piece 30 of the third portion may be extended such that the third portion 4 can be adjusted to fit a range of floor to ceiling heights when in an unfolded configuration. An adjustment of plus or minus 100 mm (4 inches) may be provided on a given ceiling height.

Figure 5:
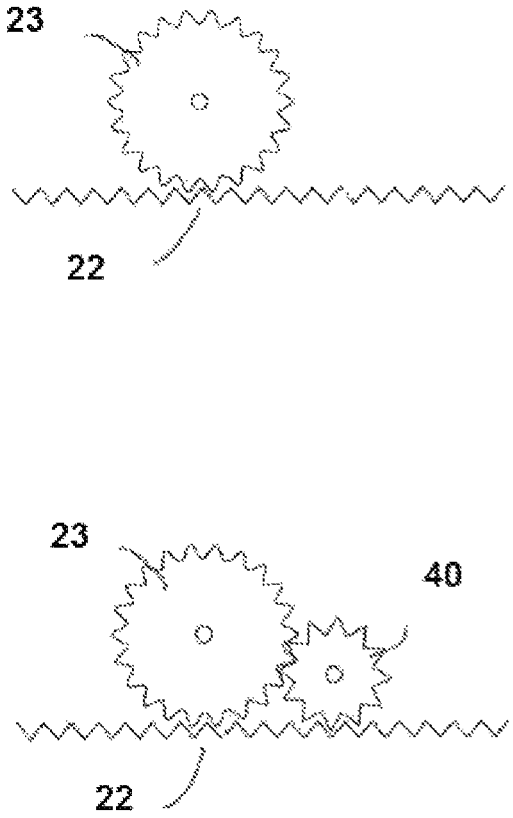
FIG. 5 shows a further embodiment of the rack and pinion mechanism of the device.

In an alternative embodiment of the invention (FIG. 5), placement of another pinion gear 40 between the rack 22 and the existing pinion gear 23 allows the opposite motion to that described above to be achieved. As such, when the actuators 27, 28 are in a retracted position, the ladder is in the folded configuration. This allows for a shorter ladder frame and a smaller overall unit size.

Closing the stairs is again triggered by the remote control. The actuators 27, 28 start to extend and thus the arm 37 extends from the sleeve piece 38, which has the effect of pushing the rack 22 beneath the pinion 23. The pinion 23 rotates upon the rack surface and as it does so, the second ladder portion 3 is folded up towards the first portion 2. Thus, the ladder 1 begins to move to the folded configuration. The cable 13 further controls the closing of the third portion 4. The third portion 4 is drawn towards its folded position atop the second portion 3. As the ladder moves towards its folded configuration, the motion of the actuators 27, 28 of the second drive mechanism activates a switch which triggers the actuators 20, 21 of the first drive mechanism. The actuators 20, 21 of the first drive mechanism act on the arm elements 7, 7' to close the cover 5 and move the ladder 1 to its folded configuration.

The ladder is fully automated, in that with the touch of a button the cover 5 opens and the ladder 1 unfolds to the floor. No manual intervention by a user is required to either open the cover or move and adjust the ladder mechanism.

The actuators 20, 21, 27, 28 are mains powered. They further comprise a built in battery backup. As such, in case of power failure, the ladder may still be operated for a limited amount of times. When power is restored, the battery goes into a charging mode.

Although the foregoing description provides embodiments of the invention by way of example, it is envisioned that other embodiments may perform similar functions and/or achieve similar results. Any and all such equivalent embodiments and examples are within the scope of the present invention. It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A foldable ladder for providing access to an opening, said foldable ladder comprising:

a first motorized drive mechanism configured to move a cover for the opening between a closed position and an open position;

a second motorized drive mechanism coupled to a plurality of foldable ladder portions, the second motorized drive mechanism configured to move the foldable ladder portions between a folded configuration and an unfolded configuration, wherein:

the first motorized drive mechanism, while moving the cover from the closed position to the open position, is configured to trigger the second motorized drive mechanism to move the ladder portions from the folded configuration to the unfolded configuration, and the second motorized drive mechanism is configured to trigger the first motorized drive mechanism to move the cover from the open position to the closed position as the ladder portions move from the unfolded configuration to the folded configuration; and wherein, the plurality of foldable ladder portions comprises:

a first portion fixable to the cover;

a second portion configured to fold between the folded configuration and the unfolded configuration about a first hinge connecting the second portion to the first portion;

a third portion configured to fold between the folded configuration and the unfolded configuration about a second hinge connecting the third portion to the second portion;

a cable that is coupled from the third portion, through a guidepiece affixed to the second portion, to the first portion such that the third portion moves concurrently with the second portion between the folded configuration and the unfolded configuration;

wherein the second motorized drive mechanism comprises a rack and a pinion, wherein the rack is configured to translate and drive a rotation of the pinion which directly rotates the second ladder portion with respect to the first ladder portion to move the foldable ladder portions between the folded configuration and the unfolded configuration; and wherein each of the first, second and third portions comprises a set of rungs.

2. The foldable ladder of claim 1, wherein the first and second drive mechanisms comprise electrical actuators.

3. The foldable ladder of claim 1, wherein the second motorized drive mechanism is positioned on the cover.

4. The foldable ladder of claim 3, wherein the first and second drive mechanisms comprise electrical actuators.

5. The foldable ladder of claim 1, wherein when in the folded configuration, the first, second and third portions rest atop each other.

6. The foldable ladder of claim 1, wherein when in the unfolded configuration, the first portion abuts the second portion and the second portion abuts the third portion.

7. The foldable ladder of claim 1 wherein the third portion further comprises an extendible end piece.

8. The foldable ladder of claim 7 wherein the extendible end piece comprises a wheel.

9. The foldable ladder of claim 1 wherein the first and second drive mechanisms are activatable by remote control.

10. A foldable ladder assembly comprising;

a frame having a cover hingedly connected thereto;

a foldable ladder positioned on the cover;

a first motorized drive mechanism positioned on the frame and connected to the cover such that the first motorized drive mechanism is configured to move the cover between an open position and a closed position;

a second motorized drive mechanism positioned on the cover and coupled to the foldable ladder such that the second motorized drive mechanism is configured to move the foldable ladder between a folded configuration and an unfolded configuration, wherein:

the first motorized drive mechanism, while moving the cover from the closed position to the open position, is configured to trigger the second motorized drive mechanism to move the foldable ladder from the folded configuration to the unfolded configuration; and the second motorized drive mechanism is configured to trigger the first motorized drive mechanism to move the cover from the open position to the dosed position as the foldable ladder moves from the unfolded configuration to the folded configuration; and wherein, the foldable ladder comprises:

a first portion fixable to the cover;

a second portion configured to fold between the folded configuration and the unfolded configuration about a first hinge connecting the second portion to the first portion;

a third portion configured to fold between the folded configuration and the unfolded configuration about a second hinge connecting the third portion to the second portion;

a cable that is coupled from the third portion, through a guidepiece affixed to the second portion, to the first portion such that the third portion moves concurrently with the second portion between the folded configuration and the unfolded configuration;

wherein the second motorized drive mechanism comprises a rack and a pinion, wherein the rack is configured to translate and drive a rotation of the pinion which directly rotates the second ladder portion with respect to the first ladder portion to move the foldable ladder portions between the folded configuration and the unfolded configuration; and wherein each of the first, second and third portions comprises a set of rungs.

* * * * *